US007125220B2

(12) United States Patent
Horng et al.

(10) Patent No.: US 7,125,220 B2
(45) Date of Patent: Oct. 24, 2006

(54) AXIAL-FLOW TYPE FAN HAVING AN AIR OUTLET BLADE STRUCTURE

(75) Inventors: Alex Horng, Kaohsiung (TW); Yin-Rong Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 114 days.

(21) Appl. No.: 10/864,503

(22) Filed: Jun. 10, 2004

(65) Prior Publication Data

US 2005/0249585 A1 Nov. 10, 2005

(51) Int. Cl.
*F01D 5/14* (2006.01)

(52) U.S. Cl. ..... 415/119; 416/228

(58) Field of Classification Search ..... 415/119; 416/228, 243; 361/695, 696, 697
See application file for complete search history.

(56) References Cited

U.S. PATENT DOCUMENTS 4,225,285 A * 9/1980 Sturm ..... 415/207
4,734,015 A 3/1988 Wrobel
4,743,173 A 5/1988 Wrobel
4,806,081 A 2/1989 Harmsen et al.
4,992,029 A 2/1991 Harmsen et al.
5,028,216 A 7/1991 Harmsen et al.
5,135,363 A 8/1992 Harmsen et al.
RE34,456 E 11/1993 Harmsen et al.
5,267,842 A 12/1993 Harmsen et al.
6,059,532 A * 5/2000 Chen et al. ..... 416/223 A
6,358,003 B1 * 3/2002 Schlechtriem ..... 415/181
6,499,948 B1 * 12/2002 Iyer et al. ..... 415/220
6,902,377 B1 * 6/2005 Crocker ..... 416/223 R
2003/0156945 A1 * 8/2003 Suzuki ..... 416/228

* cited by examiner

*Primary Examiner*—Edward K. Look
*Assistant Examiner*—Nathan Wiehe
(74) *Attorney, Agent, or Firm*—Bacon & Thomas, PLLC

(57) ABSTRACT

An axial-flow type fan includes a fan housing consisting of an air inlet, an air outlet and an air channel, and a fan wheel consisting of a hub and fan blades. The air channel of the fan housing accommodates the fan wheel which has end-cornered cutting blades proximate the air outlet of the fan housing. When the fan wheel is rotated, the end-cornered cutting blades are able to eliminate air turbulence and air noise in the air outlet of the fan housing.

7 Claims, 4 Drawing Sheets

AXIAL-FLOW TYPE FAN HAVING AN AIR OUTLET BLADE STRUCTURE

BACKGROUND OF THE INVENTION

1. Field of the Invention

The present invention relates to an axial-flow type fan having an air outlet blade structure. More particularly, the present invention relates to an axial-flow type fan having an end-cornered cutting blade structure proximate an air outlet of a fan housing, thereby reducing air-shearing noise in operation.

2. Description of the Related Art

Referring initially to FIG. 1, it illustrates a conventional fan housing structure having an air outlet connecting with an air inlet. The fan housing 10 forms an air-boosting inlet 11, an air channel 12 and an air outlet 13. A fan wheel (impeller) 20 is accommodated in the air channel 12, and consists of a hub 21 and a plurality of fan blades 22 arranged about a rotary axis of the hub 21. Each of the fan blades 22 has an air outlet corner 23. In operation, when the fan wheel 20 is rotated, the fan blades 22 drives air and the air outlet corner 23 may cause air turbulence on an inner circumference of the fan housing 10 that generates air noise. Hence, there is a need for a fan blade structure which can reduce air turbulence and air noise.

Referring to FIG. 2, it illustrates another conventional fan housing structure having an air outlet connecting with an air inlet. The construction of the conventional fan structure described above is disclosed in U.S. Pat. Nos. 4,734,015, 4,743,173, Re34,456, 4,806,081, 4,992,029, 5,028,216, 5,135,363 and 5,267,842 etc. The fan structure consists of a fan housing 10 and a fan wheel (so-called impeller) 20 accommodating therein. The construction of the fan housing 10 is shaped square including an air inlet side (so-called upstream side) and an air outlet side (so-called downstream side) disposed at its either side. The air inlet side forms an air-boosting inlet 11 while the air outlet side forming an air-expanding outlet 13'. An air channel 12 connects between the air-boosting inlet 11 and the air-expanding outlet 13'. The fan wheel 20 is accommodated in the air channel 12, and consists of a hub 21 and a plurality of fan blades 22 arranged about a rotary axis of the hub 21. The construction of the hub 21 is a barrel-shaped object having an outer circumference on which equi-spaced and titled the fan blades 22 each of which forms a flat vane. In operation, when the fan wheel 20 is rotated, the fan blades 22 drives air to suck into the fan housing 10 through the air-boosting inlet 11 that increases air pressure. Subsequently, airflow may pass through the air channel 12 and exhaust from the air-expanding outlet 13' that steadies an exhausting airflow.

However, there exist several drawbacks of the axial-flow type fan in use. Each flat vane of the fan blade 22 has an outlet corner portion 23 at its endmost corner. The outlet corner portion 23 of the fan blade 22 is situated in the longitudinal section of the air-expanding outlet 13' starting from the starting point A, as best shown in FIG. 2, and almost perpendicular to a surface of the air-expanding outlet 13'. When the fan blades 22 drive a mass of the exhausting air exhausting from the air-expanding outlet 13', the air-expanding outlet 13' guides and steadies the exhausting air for exhausting from the fan housing 10. In the longitudinal section of the air-expanding outlet 13', the flat vane portion of the outlet corner portion 23 drives a transverse airflow in the air channel 12 that may generate air turbulence on the annular surface of the air-expanding outlet 13' and cause air-shearing noise.

The present invention intends to provide an axial-flow type fan having an end-cornered cutting blade structure proximate an air outlet of a fan housing. When the fan is rotated, the end-cornered cutting blade structure is able to eliminate a transverse airflow in an air channel and thus to reduce air-shearing noise in such a way to mitigate and overcome the above problem.

SUMMARY OF THE INVENTION

The primary objective of this invention is to provide an axial-flow type fan having an air outlet blade structure, which includes a fan wheel consisting of end-cornered cutting blades to thereby eliminate air noise in an air outlet of a fan housing.

The secondary objective of this invention is to provide the axial-flow type fan having an air outlet blade structure, which includes a fan housing having an air-expanding outlet and a fan wheel consisting of end-cornered cutting blades to thereby eliminate air turbulence and air noise in an air outlet of a fan housing.

The axial-flow type fan in accordance with the present invention includes a fan housing consisting of an air inlet, an air outlet and an air channel, and a fan wheel consisting of a hub and fan blades. The air channel of the fan housing accommodates the fan wheel which has end-cornered cutting blades proximate the air outlet of the fan housing. When the fan wheel is rotated, the end-cornered cutting blades are able to eliminate air turbulence and air noise in the air outlet of the fan housing.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings wherein.

DETAILED DESCRIPTION OF THE INVENTION

Figure 1:
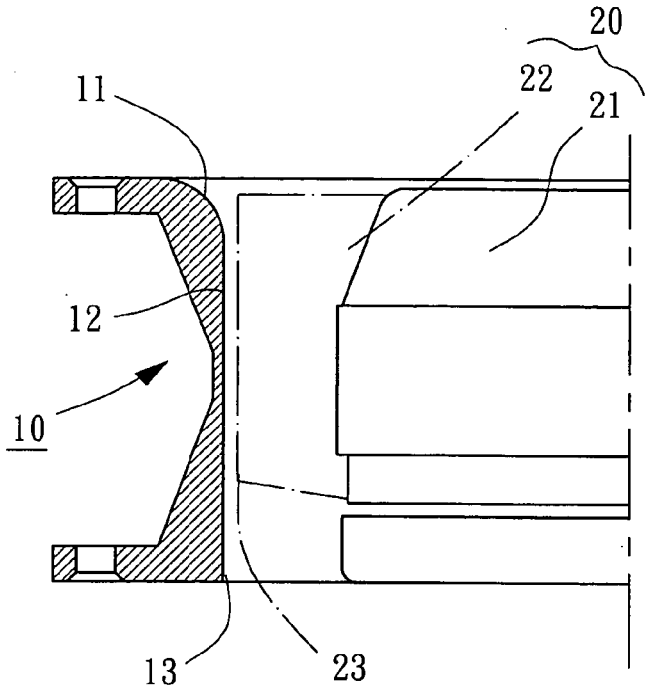
FIG. 1 PRIOR ART
FIG. 1 is a cutaway cross-sectional view of a conventional fan housing structure in accordance with the prior art.
Figure 2:
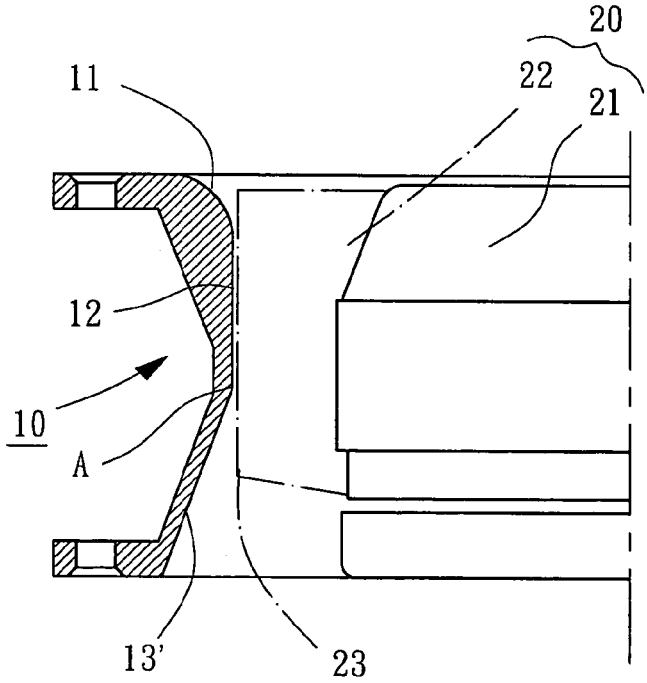
FIG. 2 PRIOR ART
FIG. 2 is a cutaway cross-sectional view of another conventional fan housing structure in accordance with the prior art.

Referring to FIGS. 3 through 6, reference numerals of the first and second embodiments of the present invention have applied the identical numerals of the conventional fan structure, as shown in FIGS. 1 and 2. The construction of the fan structure in accordance with the embodiments of the present invention have similar configuration and same function as those of the conventional fan structure and detailed descriptions may be omitted.

Figure 3:
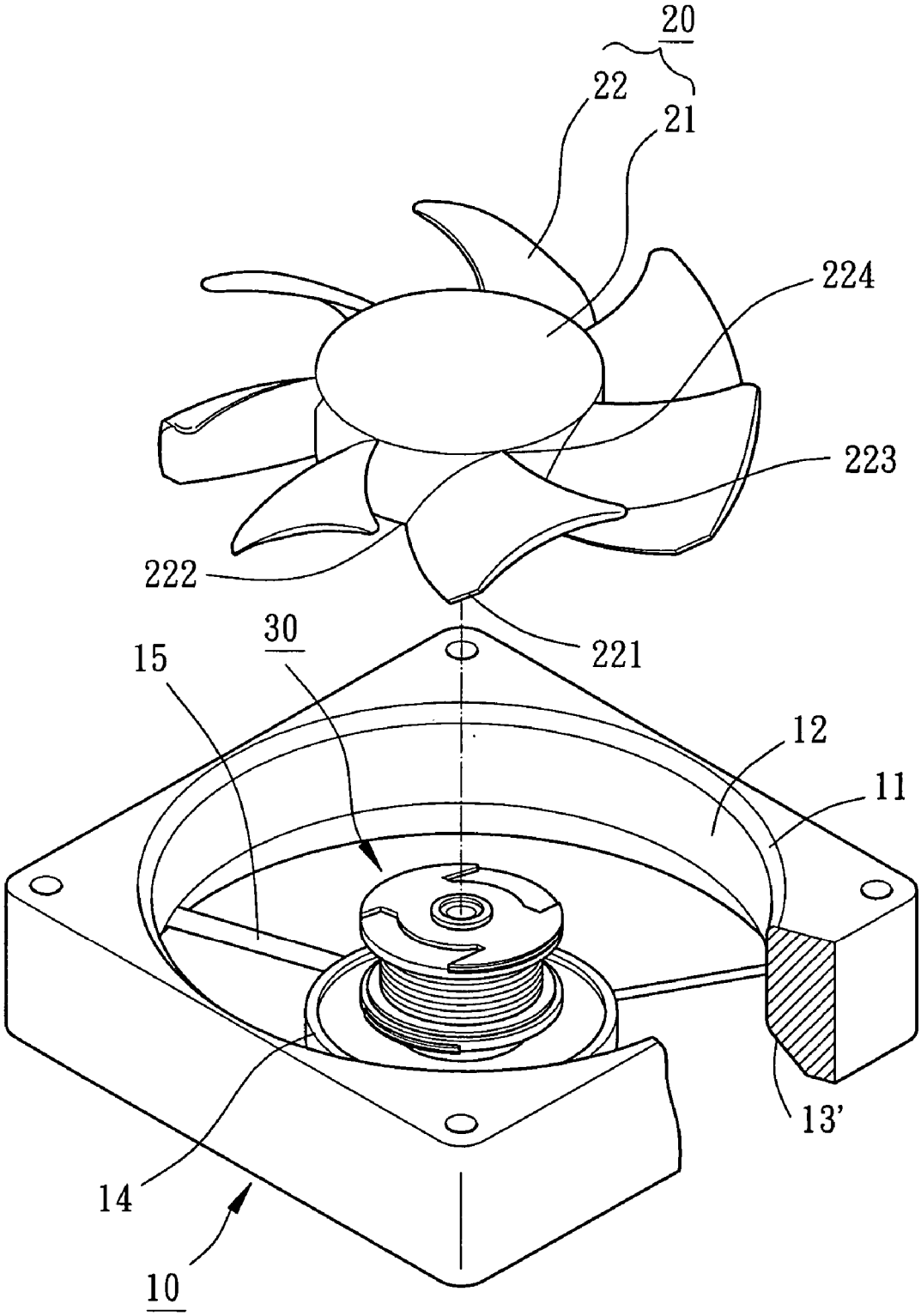
FIG. 3 is an exploded perspective view of an axial-flow type fan having an air outlet blade structure in accordance with a first embodiment of the present invention.
Figure 4:
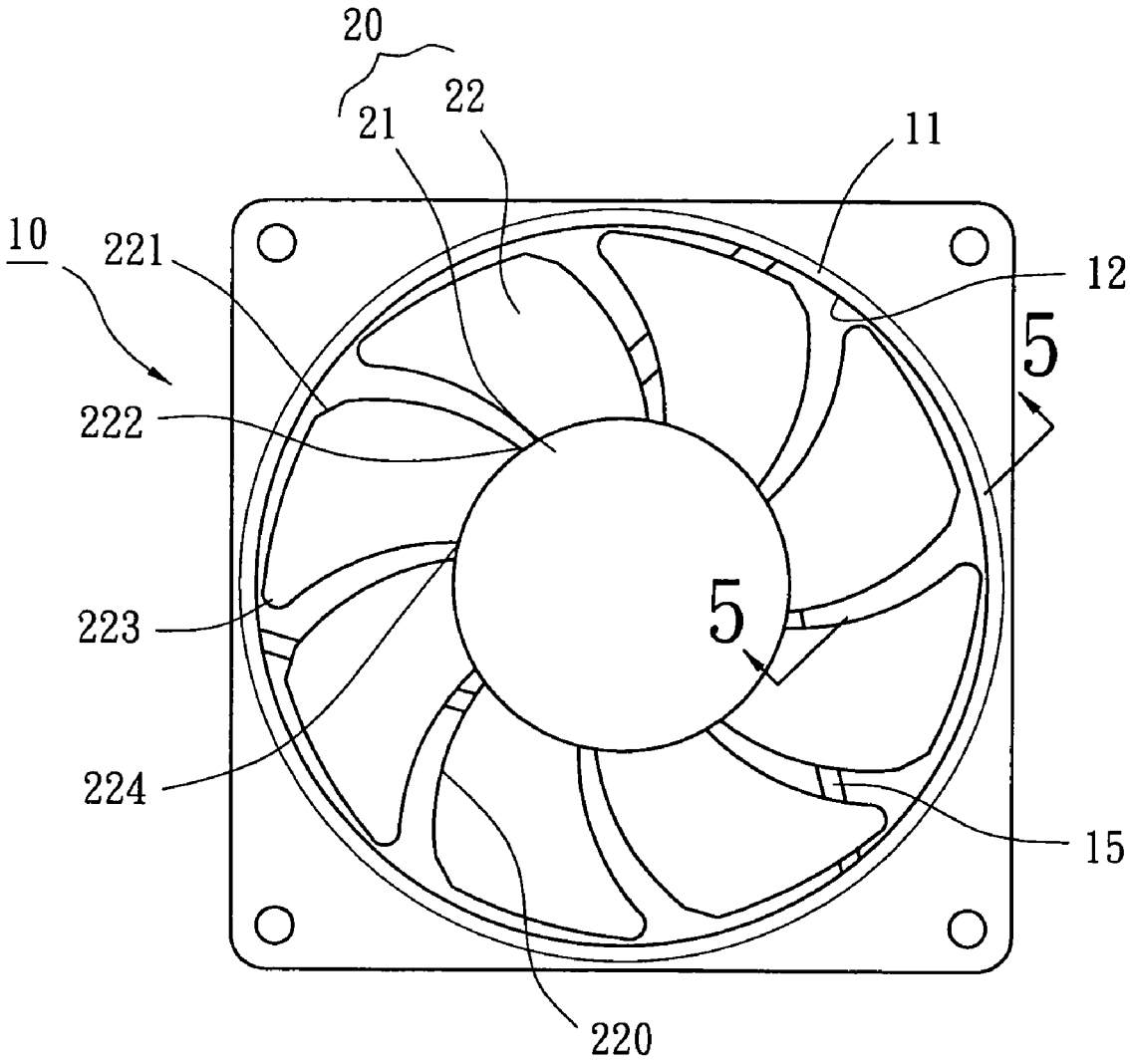
FIG. 4 is a top plan view of the axial-flow type fan having the air outlet blade structure in accordance with the first embodiment of the present invention.
Figure 5:
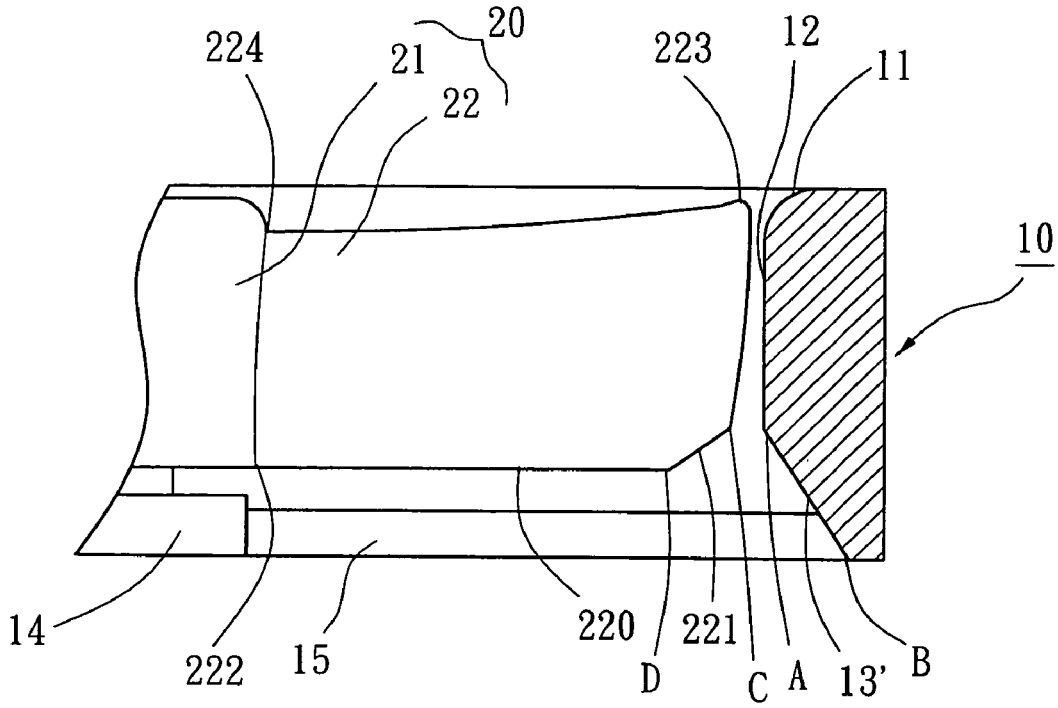
FIG. 5 is a cross-sectional view, taken along line 5—5 in FIG. 4, of the axial-flow type fan having an air outlet blade structure in accordance with the first embodiment of the present invention.

Referring to FIGS. 3 through 5, an axial-flow type fan in accordance with a first embodiment of the present invention includes a fan housing 10 and a fan wheel 20.

Referring again to FIGS. 3 through 5, construction of the fan housing 10 shall be described in detail. The fan housing 10 is made of plastic or metal material, and formed with a square or circular hollow body. The fan housing 10 consists of an air-boosting inlet 11, an air channel 12, an air-expanding outlet 13', a base 14 and a plurality of supporting ribs 15. The air inlet side of the fan housing 10 provides with the air-boosting inlet 11 which is formed with an annular tapered surface for increasing air inflow and air pressure. The air-boosting inlet 11 further communicates with the air channel 12. Meanwhile, the air outlet side of the fan housing 10 provides with the air-expanding outlet 13' which is formed with an annular expanded surface for increasing air outflow. The base 14 is disposed in the air-expanding outlet 13' to support a motor stator 30 which is combined with the fan wheel 20 as well as a motor rotor (not labeled). The supporting ribs 15 are about a rotary axis of the fan housing 10, and thus connect between the base 14 and the fan housing 10.

Still referring to FIGS. 3 through 5, construction of the fan wheel 20 shall be described in detail. The fan wheel 20 is made of plastic or metal material, and consists of a hub 21 and a plurality of fan blades 22 arranged about a rotary axis of the hub 21. The construction of the hub 21 is a barrel-shaped object having an outer circumference on which are situated equi-spaced and tilted fan blades 22, each of which forms a curve vane. The curve vane of each fan blade 22 has an end-cornered cutting section 221, an outlet bottom point 222, an inlet corner portion 223 and an inlet bottom point 224. The end-cornered cutting section 221 is a straight line extending from an outlet edge 220 to a radial end edge of the fan blade 22. Each of the fan blades 22 tilts on the outer circumference of the hub 21 and extends from the outlet bottom point 222 to the inlet bottom point 224, as best shown in FIG. 3. The inlet corner portion 223 of the fan blade 22 is a topmost end proximate an air inlet side of the fan wheel 20, as best shown in FIG. 4. Also, the inlet corner portion 223 of the fan blade 22 is a topmost toe extending along a leading edge while the inlet bottom point 224 forming a bottom heel, as best shown in FIG. 3.

Referring again to FIG. 5, when the fan housing 10 and the fan wheel 20 are assembled, there are several assembled relationships between the fan housing 10 and the fan wheel 20. First, a leading point C of the end-cornered cutting section 221 is aligned with a starting point A of the air-expanding outlet 13', thereby precisely reducing air turbulence on the surface of the air-expanding outlet 13'. Alternatively, a leading point C of the end-cornered cutting section 221 is arranged closer to the air inlet end of the fan housing 10 than a starting point A of the air-expanding outlet 13', thereby precisely confining to reduce air turbulence within the air-expanding outlet 13'. Second, a trailing point D of the end-cornered cutting section 221 is situated between the starting point A and the terminal point B of the air-expanding outlet 13', thereby precisely confining to reduce air turbulence within the air-expanding outlet 13'. Thirdly, a trailing point D of the end-cornered cutting section 221 is proximate the surface of the air-expanding outlet 13'. Preferably, the ratio of a radial length of the end-cornered cutting section 221 to a total radial length of the fan blade 22 ranges between $1/10$and $1/2$, thereby preventing an axial flow from interfering with the end-cornered cutting section 221. Fourthly, a leading point C of the end-cornered cutting section 221 is proximate the surface of the air-expanding outlet 13'. Preferably, the ratio of an axial length of the end-cornered cutting section 221 to a total axial length of the fan blade 22 ranges between $1/10$ and $1/2$, thereby precisely confining to reduce air turbulence within the air-expanding outlet 13'. By use such an assembled relationship, when the fan blades 22 drive a mass of the exhausting air exhausting from the air-expanding outlet 13', the air-expanding outlet 13' guides and steadies the exhausting air for exhausting from the fan housing 10. Subsequently, the end-cornered cutting section 221 of the fan blade 22 can prevent from driving air along a longitudinal direction on the air-expanding outlet 13', thereby reducing to generate air turbulence. Consequently, the expanding airflow generated from the air-expanding outlet 13' can effectively reduce air noise of the air-expanding outlet 13' of the fan housing 10. Moreover, the inlet corner portion 223 of the fan blade 22 is further situated in the tapered surface of the air-boosting inlet 11. Consequently, the inlet corner portion 223 of the fan blade 22 carries out a preferred air-shearing effect that can further reduce air noise in the air inlet 11 in addition to the air outlet blade structure of the present invention.

Figure 6:
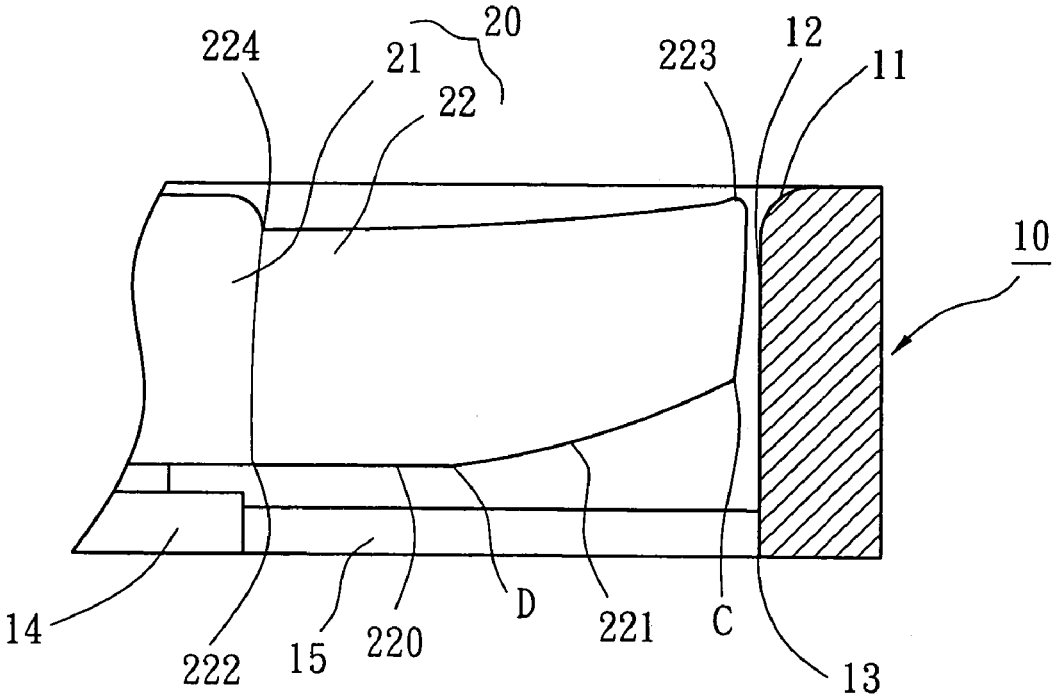
FIG. 6 is a cross-sectional view, similar to that shown in FIG. 5, of an axial-flow type fan having an air outlet blade structure in accordance with a second embodiment of the present invention.

Turning now to FIG. 6, as is known in the first embodiment, an axial-flow type fan in accordance with a second embodiment of the present invention includes a fan housing 10 and a fan wheel 20. In comparison with the first embodiment, the fan housing 10 of the second embodiment consists of an air-boosting inlet 11, an air channel 12 and a cylindrical air outlet 13. Each fan blade 22 has an end-cornered cutting section 221 which forms a curve line extending from an outlet edge 220 to a radial end edge of the fan blade 22. Thus, when the fan wheel 20 is rotated, the end-cornered cutting sections 221 are able to reduce airflow impacting on the surface of the air outlet 13 of the fan housing 10. Consequently, the end-cornered cutting sections 221 of the fan blades 22 eliminate air turbulence and air noise in the air outlet 13 of the fan housing 10.

Referring back to FIG. 1, the conventional axial-flow type fan includes the air outlet 13, and the fan blades 22 having the air outlet corners 23 which may cause air turbulence on an inner circumference of the air outlet 13 of the fan housing 10 that generates air noise. Further referring back to FIG. 2, another conventional axial-flow type fan includes the air-expanding outlet 13', and the fan blades 22 having the air outlet corners 23 which may cause air turbulence on an inner circumference of the air-expanding outlet 13' of the fan housing 10 that generates air noise. However, the present invention employs the fan blade 22 having the end-cornered cutting section 221 proximate the surface of the cylindrical air outlet 13 or the air-expanding outlet 13' that may reduce generating air turbulence and air noise, as best shown in FIGS. 5 and 6.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. An axial-flow type fan, comprising:

a fan housing including an air inlet and an air outlet at its outer side, said air outlet having an air-expanding section for expanding an exhausting airflow exhausting from the air outlet;

an air channel connecting the air inlet and the air outlet;

a fan wheel received in the channel and including a hub; and a plurality of fan blades arranged about a rotary axis of the fan wheel and tilted on the hub, and each of the fan blades having an end-cornered cutting section, each of said end-cornered cutting sections having a leading point substantially aligned with a starting point of the air-expanding outlet, thereby reducing air turbulence on a surface of the air-expanding outlet;

wherein when the fan wheel is rotated, the end-cornered cutting sections of the blades are able to eliminate air turbulence and air noise in the air outlet of the fan housing.

2. The axial-flow type fan as defined in claim 1, wherein the end-cornered cutting section has a trailing point proximate the surface of the air outlet, and the ratio of a radial length of the end-cornered cutting section to a total axial length of the fan blade ranging from between 1/10 and 1/2, thereby preventing an axial flow from interfering with the end-cornered cutting section.

3. The axial-flow type fan as defined in claim 2, wherein the end-cornered cutting section is a straight line extending from an outlet edge to a radial end edge of the fan blade.

4. The axial-flow type fan as defined in claim 2, wherein the end-cornered cutting section is a curved line extending from an outlet edge to a radial end edge of the fan blade.

5. The axial-flow type fan as defined in claim 1, wherein the end-cornered cutting section has the leading point arranged closer to the air outlet end of the fan housing than a starting point of the air-expanding outlet.

6. The axial-flow type fan as defined in claim 1, wherein the end-cornered cutting section has a trailing point situated between the starting point and a terminal point of the air-expanding outlet.

7. The axial-flow type fan as defined in claim 1, wherein the end-cornered cutting section has the leading point proximate the surface of the air-expanding outlet, and the ratio of an axial length of the end-cornered cutting section to a total axial length of the fan blade ranging between 1/10 and 1/2.

* * * * *